US009109602B2

(12) United States Patent
Song

(10) Patent No.: US 9,109,602 B2
(45) Date of Patent: Aug. 18, 2015

(54) DIFFUSER BUMP VANE PROFILE

(75) Inventor: Baojun Song, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 635 days.

(21) Appl. No.: 13/435,559

(22) Filed: Mar. 30, 2012

(65) Prior Publication Data

US 2012/0288385 A1 Nov. 15, 2012

Related U.S. Application Data

(60) Provisional application No. 61/485,952, filed on May 13, 2011.

(51) Int. Cl.
*F04D 29/44* (2006.01)
*F04D 13/10* (2006.01)
*F04D 29/54* (2006.01)

(52) U.S. Cl.
CPC ..... *F04D 13/10* (2013.01); *F04D 29/448* (2013.01); *F04D 29/548* (2013.01)

(58) Field of Classification Search
CPC ..... F05D 2240/124; F04D 29/448; F04D 29/548; F04D 13/08; F04D 13/10
USPC ..... 415/199.2, 191, 208.1, 211.2; 416/243, 416/242, 235; 417/423.3, 424.1, 423.1
See application file for complete search history.

(56) References Cited

U.S. PATENT DOCUMENTS 895,604 A * 8/1908 Udstad ..... 415/206
4,208,169 A * 6/1980 Becker et al. ..... 416/185
6,905,310 B2 * 6/2005 Kawamoto et al. ..... 416/175
7,857,577 B2 * 12/2010 Eslinger ..... 415/1
2003/0170112 A1 9/2003 Kao
2004/0047728 A1 3/2004 Kao
2005/0186065 A1 8/2005 Wilson et al.
2008/0199300 A1 8/2008 Eslinger
2009/0092478 A1 4/2009 Eslinger
2009/0285678 A1 11/2009 Brunner et al.
2010/0221105 A1 9/2010 Markovitch
2010/0239417 A1 9/2010 Scott
2010/0284812 A1 11/2010 Zahdeh
2011/0194926 A1 8/2011 Stair et al.
2012/0057970 A1 3/2012 Tingler

OTHER PUBLICATIONS

U.S. Appl. No. 13/276,449, filed Oct. 19, 2011; First inventor: Alan Lin Kao.
International Search Report and Written Opinion (PCT/US2012/032864), dated Oct. 19, 2012.

* cited by examiner

*Primary Examiner* — Dwayne J White
*Assistant Examiner* — Jason Fountain
(74) *Attorney, Agent, or Firm* — Bracewell & Giuliani LLP

(57) ABSTRACT

An electric submersible pump (ESP) assembly increases pump efficiency and pump head with a diffuser that includes a diffuser vane having a low pressure surface with a length greater than a length of a high pressure surface of the vane. The diffuser vane includes a leading edge at a downstream end of the vane and a trailing edge at an upstream end of the vane. The curved high pressure surface extends between the leading edge and the trailing edge. The curved low pressure surface extends between the leading edge and the trailing edge opposite the high pressure surface. The low pressure surface has a bump formed thereon to increase the length of the low pressure surface so that fluid flowing along the low pressure surface is substantially laminar, thereby increasing pump efficiency and pump head.

20 Claims, 4 Drawing Sheets

DIFFUSER BUMP VANE PROFILE

This application claims priority to and the benefit of U.S. Provisional Application No. 61/485,952, by Song, filed on May 13, 2011, entitled "Diffuser Bump Vane Profile," which application is incorporated herein by reference.

FIELD OF THE INVENTION

This invention relates in general to pumps and, in particular, to a pump diffuser for a more laminar fluid flow profile through the diffuser during operation of the ESP.

BRIEF DESCRIPTION OF RELATED ART

Wells may use an artificial lift system, such as an electric submersible pump (ESP) to lift well fluids to the surface. Where ESPs are used, the ESP may be deployed by connecting the ESP to a downhole end of a tubing string and then run into the well on the end of the tubing string. The ESP may be connected to the tubing string by any suitable manner. In some examples, the ESP connects to the tubing string with a threaded connection so that an uphole end or discharge of the ESP threads onto the downhole end of the tubing string.

ESPs generally include a pump portion and a motor portion. Generally, the motor portion is downhole from the pump portion, and a rotatable shaft connects the motor and the pump. The rotatable shaft is usually one or more shafts operationally coupled together. The motor rotates the shaft that, in turn, rotates components within the pump to lift fluid through a production tubing string to the surface. ESP assemblies may also include one or more seal sections coupled to the shaft between the motor and pump. In some embodiments, the seal section connects the motor shaft to the pump intake shaft. Some ESP assemblies include one or more gas separators. The gas separators couple to the shaft at the pump intake and separate gas from the wellbore fluid prior to the entry of the fluid into the pump.

The pump portion includes a stack of impellers and diffusers. The impellers and diffusers are alternatingly positioned in the stack so that fluid leaving an impeller will flow into an adjacent diffuser and so on. Generally, the diffusers direct fluid from a radially outward location of the pump back toward the shaft, while the impellers accelerate fluid from an area proximate to the shaft to the radially outward location of the pump. Each impeller and diffuser may be referred to as a pump stage. The shaft couples to the impeller to rotate the impeller within the non-rotating diffuser. In this manner, the stage may pressurize the fluid to lift the fluid through the tubing string to the surface.

Generally, the impellers lift the fluid by accelerating fluid from a location proximate to the rotating shaft radially outward to an area proximate to a pump housing. There, the fluid is directed into the diffuser which directs the fluid back toward the rotating shaft. Diffusers accomplish this with a plurality of vanes that have a leading edge proximate to the pump housing and a trailing edge proximate to the rotating shaft. The impeller of the next pump stage then accelerates the fluid as described above to further pressurize the fluid and continue the lifting process. Each vane of the diffuser may have a high pressure surface and a low pressure surface, the fluid generally flowing primarily along the low pressure surface. As the fluid moves along the low pressure side, it may separate from the low pressure surface causing the flow to be turbulent. Turbulent flow decreases the ability of the impeller in the next pump stage to accelerate the fluid, thereby decreasing pump efficiency and the overall pump head. Modern pumps attempt to decrease fluid separation from the diffuser vanes by having a longer axial length that allows fluid to traverse from a radially outward to a radially inward position. The longer axial length allows for a gradual fluid transition. However, in modern pumps in oil and gas environments, there may be insufficient space to include long diffusers in ESPs. Therefore, there is a need for a diffuser having vanes that experience decreased fluid separation over prior art diffusers.

SUMMARY OF THE INVENTION

These and other problems are generally solved or circumvented, and technical advantages are generally achieved, by preferred embodiments of the present invention that provide a diffuser of an electric submersible pump having a bump formed thereon and a method to increase pump efficiency and head.

In accordance with an embodiment of the present invention, an electric submersible pump (ESP) assembly is disclosed. The ESP includes a pump having an impeller for moving fluid, a motor coupled to the submersible pump so that the motor may variably rotate the impeller in the pump, and a diffuser in the pump downstream of the impeller so that the diffuser will direct moving fluid from the impeller toward a rotating shaft in the pump with minimal separation of the fluid from the diffuser. The diffuser includes a frustoconical body having a central bore for passage of a rotating shaft, and a plurality of vanes formed on an exterior surface of the frustoconical body. Each vane has a leading edge at a downstream end of the vane, and a trailing edge at an upstream end of the vane. A curved high pressure surface extends between the leading edge and the trailing edge. A curved low pressure surface extends between the leading edge and the trailing edge opposite the high pressure surface. The low pressure surface has a length greater than the length of the high pressure surface so that fluid flowing along the low pressure surface is substantially laminar.

In accordance with another embodiment of the present invention, an electric submersible pump (ESP) assembly is disclosed. The ESP includes a pump having an impeller for moving fluid, a motor coupled to the submersible pump so that the motor may variably rotate the impeller in the pump, and a diffuser in the pump downstream of the impeller so that the diffuser will direct moving fluid from the impeller toward a rotating shaft in the pump with minimal separation of the fluid from the diffuser. The diffuser includes a frustoconical body having a central bore for passage of a rotating shaft, and a plurality of vanes formed on an exterior surface of the frustoconical body. Each vane has a leading edge at a downstream end of the vane, and a trailing edge at an upstream end of the vane. A curved high pressure surface extends between the leading edge and the trailing edge. A curved low pressure surface extends between the leading edge and the trailing edge opposite the high pressure surface. The low pressure surface has a bump formed thereon. The width of each vane increases from the leading edge to the bump and decreases from the bump to the trailing edge such that the increase and decrease in width occurs on the low pressure surface to increase the length of the low pressure surface from the leading edge to the trailing edge so that the fluid flow along the low pressure surface is substantially laminar.

In accordance with yet another embodiment of the present invention, a method for increasing pump efficiency and pumping head of an electric submersible pumping (ESP) system is disclosed. The method provides an ESP having a pump portion and a motor portion and positions an impeller in the pump portion for moving fluid, the impeller keyed to a rotating shaft in the pump portion. The method also positions a diffuser downstream of the impeller so that the diffuser will direct moving fluid discharged from the impeller toward the rotating shaft in the pump portion. The method mechanically couples the motor portion to the pump portion so that the motor portion may variably rotate the impeller in the pump. Rotation of the impeller accelerates fluid from an area proximate to the rotating shaft and discharges the fluid proximate to a leading edge of a vane of the diffuser. The method forms the diffuser so that the vane of the diffuser has a low pressure surface with a length greater than the length of a high pressure surface of the vane, the high pressure surface opposite the low pressure surface.

The disclosed embodiments provide an ESP with decreased separation of fluid from the vanes of the diffuser. Inclusion of a bump in the diffuser vane increases the length of the vane without increasing the axial length of the diffuser. This causes a decrease in fluid turbidity as the fluid flows through the diffuser and into the downstream impeller. As a result, pump efficiency and pumping head increase. In addition, the disclosed embodiments provide an ESP with decreased separation of fluid from the blades of the impeller. Again, this causes a decrease in fluid turbidity as it flows from the impeller into the downstream diffuser. As a result, pump efficiency and pumping head increase.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning electric submersible pump operation, construction, use, and the like have been omitted inasmuch as such details are not considered necessary to obtain a complete understanding of the present invention, and are considered to be within the skills of persons skilled in the relevant art.

Figure 1:
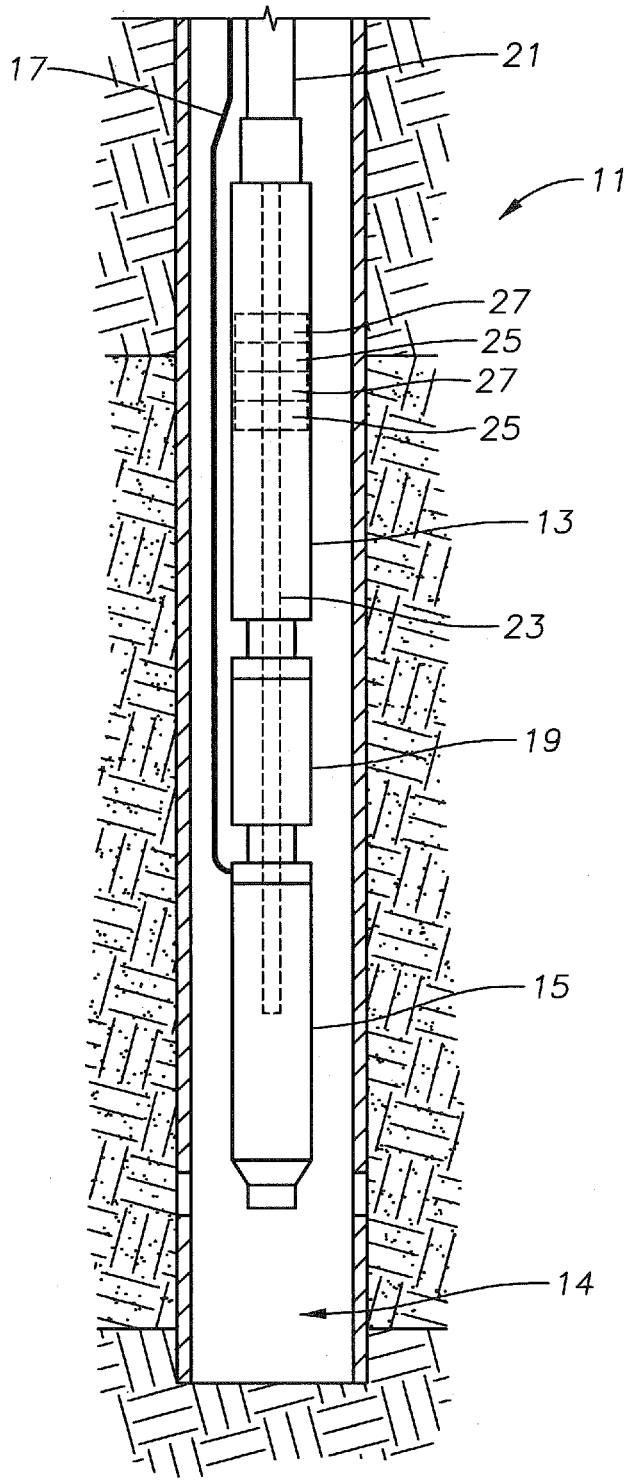
FIG. 1 is a schematic representation of an electric submersible pump coupled inline to a production string and suspended within a casing string.

The exemplary embodiments of the downhole assembly of the present invention are used in oil and gas wells for producing large volumes of well fluid. As illustrated in FIG. 1, a downhole assembly 11 has an electric submersible pump 13 ("ESP") with a large number of stages of impellers 25 and diffusers 27. ESP 13 is driven by a downhole motor 15, which is a large three-phase AC motor. Motor 15 receives power from a power source (not shown) via power cable 17. Motor 15 is filled with a dielectric lubricant. A seal section 19 separates motor 15 from ESP 13 for equalizing internal pressure of lubricant within the motor to that of the well bore. Additional components may be included, such as a gas separator, a sand separator, and a pressure and temperature measuring module. Large ESP assemblies may exceed 100 feet in length. An upper end of ESP 13 couples to production string 21.

A rotating shaft 23 may extend from motor 15 up through seal section 19 and through ESP 13. Motor 15 may rotate shaft 23 to, in turn, rotate impellers 25 within ESP 13. A person skilled in the art will understand that shaft 23 may comprise multiple shafts configured to rotate in response to rotation of the adjacent upstream coupled shaft. Impellers 25 will generally operate to lift fluid within ESP 13 and move the fluid up production string 21. Impellers 25 perform this function by drawing fluid into a center of each impeller 25 near shaft 23 and accelerating the fluid radially outward. Generally, the fluid accelerated by each impeller 25 will then flow into a diffuser 27 axially above impeller 25. There, the fluid is directed from a radially outward position to a radially inward position adjacent shaft 23 where the fluid is drawn into a center of the next impeller 25.

Figure 2:
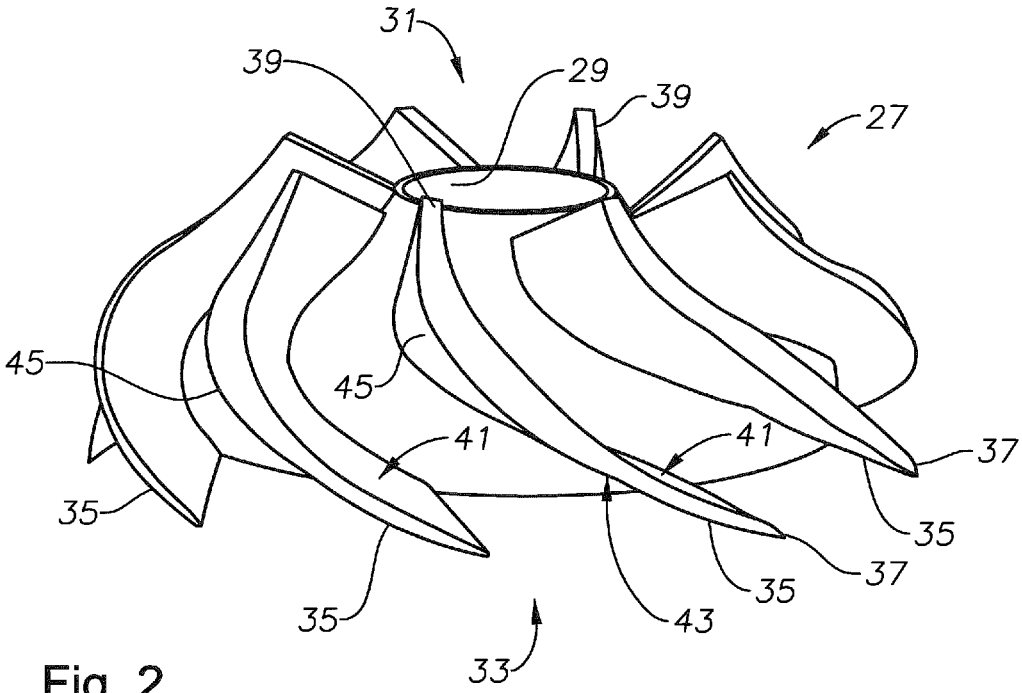
FIG. 2 is a perspective view of a diffuser in accordance with an embodiment of the present invention.
Figure 3:
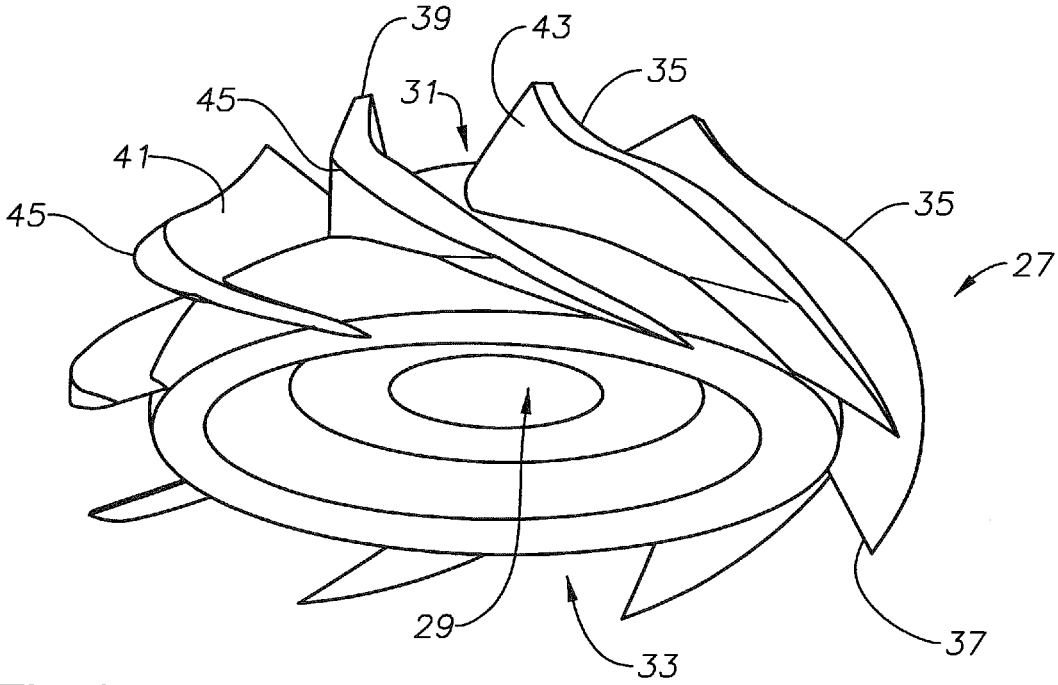
FIG. 3 is a perspective view of the diffuser of FIG. 2 shown from the opposite side.

Referring to FIGS. 2 and 3, diffuser 27 is a generally frustoconical body having a central bore 29 through which shaft 23 may pass. Bore 29 may be sealed to but not rotate with rotating shaft 23 to prevent passage of fluid between shaft 23 and diffuser 27. A downstream end 31 of diffuser 27 comprises the narrower end of the frustoconical body, and an upstream end 33 comprises the wider end of the frustoconical body. In the illustrated embodiment, the exterior surface of diffuser 27 extends downstream from upstream end 33. Then, the exterior surface of diffuser 27 curves inward before curving downstream to downstream end 31 such that the exterior surface of diffuser 27 is substantially bell shaped.

Figure 4:
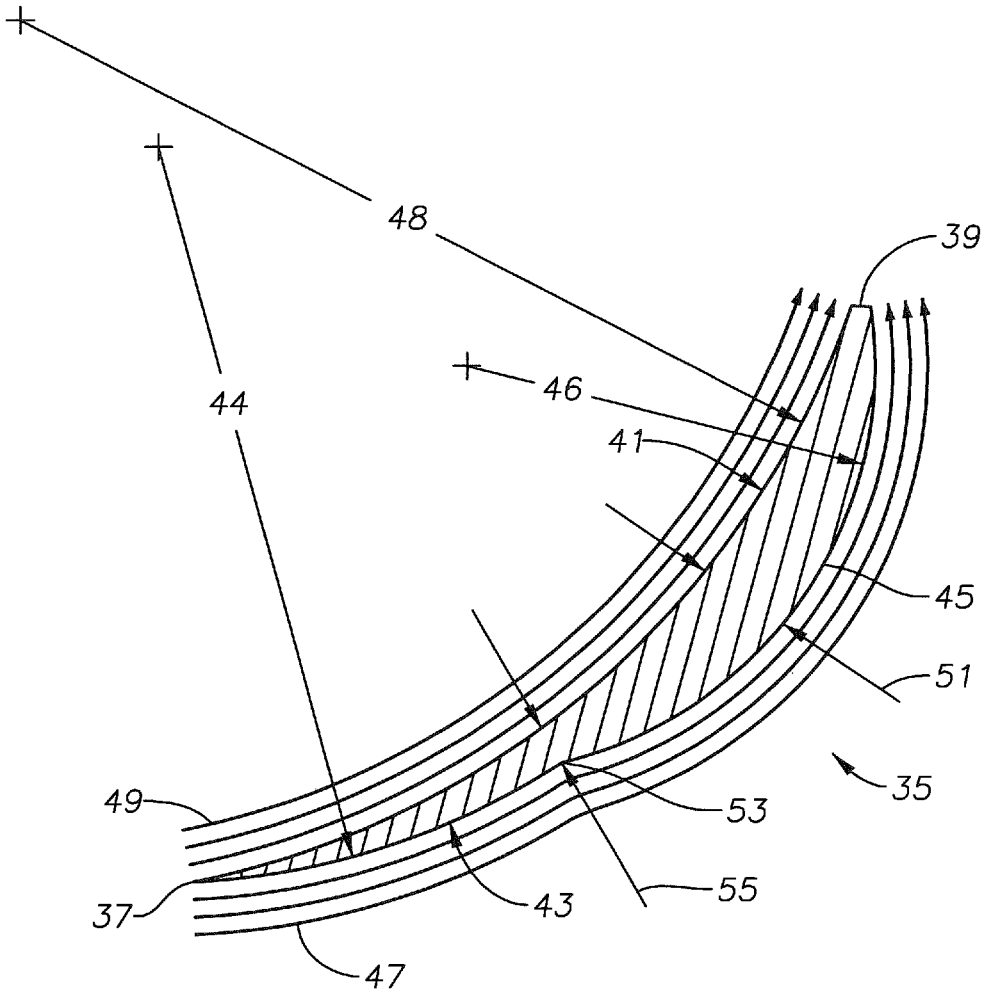
FIG. 4 is a sectional view of a vane for the diffuser of FIG. 2 or an impeller.

Diffuser 27 includes a plurality of vanes 35 formed on the exterior surface of diffuser 27. Each vane 35 has a leading edge 37, a trailing edge 39, a high pressure surface 41, and a low pressure surface 43. In the illustrated embodiment, the width at leading edge 37 and trailing edge 39 from high pressure surface 41 to low pressure surface 43 is substantially equivalent. However, the width of vane 35 varies between high pressure surface 41 and low pressure surface 43 from leading edge 37 to trailing edge 39 as shown in FIG. 4. Low pressure surface 43 may be a convex curved surface, and high pressure surface 41 is a concave curved surface. A person skilled in the art will recognize that a shell or housing fits over the vanes to enclose each flow channel. This shell is not illustrated herein for clarity.

Referring to FIG. 4, high pressure surface 41 and low pressure surface 43 are curved between leading edge 37 and trailing edge 39. A fluid path 47 flowing adjacent low pressure surface 43 is longer than a fluid path 49 flowing adjacent to high pressure surface 41. This is accomplished by including a bump 45 in each vane 35. Bump 45 may be a portion of vane 35 that has a width 51 greater than the width of vane 35 at leading edge 37 and trailing edge 39. The width of vane 35 will taper out gradually from leading edge 37 to a base 53 of bump 45. At base 53, the width of vane 35 increases from a width 55 at base 53 to width 51. The rate of increase of the width of vane 35 from width 55 to width 51 is greater than the rate of increase of the width of vane 35 from leading edge 37 to width 55. In an embodiment, width 51 may be two to four times width 55. Base 53 corresponds with an area of low pressure surface 43 where fluid path 47 may separate from low pressure surface 43. By increasing the width of vane 35 at bump 45, low pressure surface 43 more closely matches fluid path 47. Thus, when the momentum of moving fluid along fluid path 47 tends to overcome the frictional forces maintaining the fluid in contact with low pressure surface 43, vane 35 increases in width to track the predicted flow path were fluid path 47 to remain attached to low pressure surface 43. From width 51, bump 45 will decrease in width from width 51 to trailing edge 39 at a rate similar to the rate of increase of width from width 55 to width 51. In the illustrated embodiment of FIG. 4, low pressure surface 43 may have a radius 44 between leading edge 37 and base 53 and a radius 46 at bump 45. A person skilled in the art will recognize that radius 44 may be larger than radius 46 so that the curvature of bump 45 is greater than the curvature of low pressure surface 43 between leading edge 37 and base 53. High pressure surface 41 may have a radius 48 between leading edge 37 and trailing edge 39. A person skilled in the art will recognize that high pressure surface 41 may have a compound curvature with more than one radius 48.

As described above, bump 45 protrudes from low pressure surface 43. Low pressure surface 43 traverses the change in width in a smooth gradual manner that minimizes edges, or sudden protrusions, between leading edge 37, bump 45, and trailing edge 39. In the illustrated embodiment, bump 45 is placed such that width 51 is proximate to trailing edge 39. This placement coincides with the expected fluid boundary layer along low pressure surface 43 so that width 51 is coincides with the expected transition location of laminar flow to turbulent flow along low pressure surface 43. In this manner, fluid flow along low pressure surface 43 will separate from low pressure surface 43 at a decreased rate, thereby decreasing turbidity of flow into the downstream impeller 25. This increases efficiency and pumping head of ESP 13. In an embodiment, width 51 may be located at a location that is 25% to 40% of the distance from trailing edge 39 of the length of low pressure surface 43 between leading edge 37 and trailing edge 39.

Width 51 of bump 45 from high pressure surface 41 to low pressure surface 43 may vary according to the particular ESP in which diffuser 27 is placed. The position of bump 45 may also vary between leading edge 37 and trailing edge 39. Preferably, bump 45 will be positioned so as to increase the length of low pressure surface 43 with a minimum of disruption to flow path 47 along low pressure surface 43. Generally, this will correspond with a position for bump 45 proximate to trailing edge 39 along low pressure surface 43.

Figure 5:
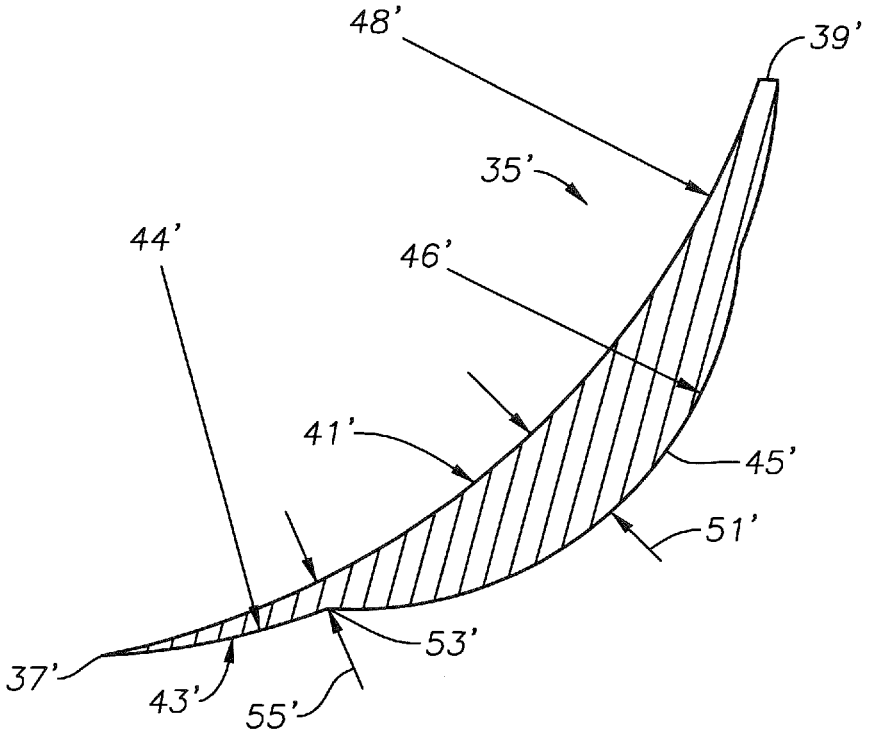
FIG. 5 is a sectional view of an alternative vane for a diffuser or an impeller.
Figure 6:
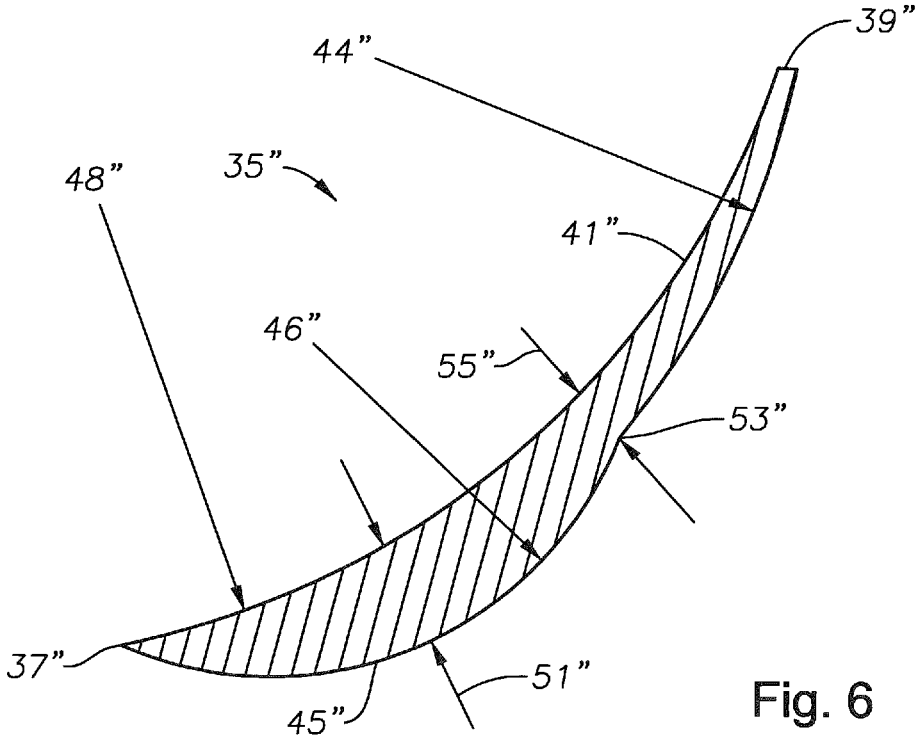
FIG. 6 is a sectional view of an alternative vane for a diffuser or an impeller.

As shown in FIGS. 5 and 6, bump 45 may be positioned at other locations along low pressure surface 43. In the illustrated embodiment of FIG. 5, a vane 35' includes a bump 45' positioned approximately halfway between leading edge 37' and trailing edge 39'. As shown, this places width 51' approximately halfway between leading edge 37' and trailing edge 39'. Vane 35' will include the components of and operate as vane 35 of FIG. 4 described above. In the illustrated embodiment of FIG. 6, vane 35" includes a bump 45" positioned proximate to leading edge 37". In an embodiment, width 51" may be located at a location that is 25% to 40% of the distance from leading edge 37" of the length of low pressure surface 43" between leading edge 37" and trailing edge 39". Vane 35" will include the components of and operate as vane 35 of FIG. 4 described above.

In other alternative embodiments, a bump 45 may also be placed on impeller 25. A bump will be formed on the low pressure side of each blade of impeller 25. As described above with respect to diffuser 27, the bump of impeller 25 will be formed to increase the width between the high pressure surface of each blade of impeller 25 and the low pressure surface of each blade of impeller 25. Similar to diffuser 27, the low pressure surface of each blade of impeller 25 will be smooth to decrease separation of the moving fluid from the low pressure surface of each blade of impeller 25. As a result, this will decrease turbidity. The decreased turbidity of flow through impeller 25 will increase overall efficiency of ESP 13 and increase pumping head of ESP 13. A person skilled in the art will recognize that the vanes 35 illustrated in FIGS. 4-6 may be considered to be either a vane of a diffuser or a vane of an impeller.

Accordingly, the disclosed embodiments provide numerous advantages. For example, the disclosed embodiments provide an ESP with decreased separation of fluid from the vanes of the diffuser. Generally, diffusers accomplish decreased separation by having a longer axial length that allows fluid to traverse from a radially outward to a radially inward position. The longer axial length allows for a gradual fluid transition. However, in modern pumps in oil and gas environments, there is insufficient space to include long diffusers in ESPs. Inclusion of a bump in the diffuser vane overcomes this longstanding problem by increasing the length of the vane without increasing the axial length of the diffuser. This causes a decrease in fluid turbidity as the fluid flows through the diffuser and into the downstream impeller. As a result, pump efficiency and pumping head increase. In addition, the disclosed embodiments provide an ESP with decreased separation of fluid from the blades of the impeller. Again, this causes a decrease in fluid turbidity as it flows from the impeller into the downstream diffuser. As a result, pump efficiency and pumping head increase.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. An electric submersible pump (ESP) assembly comprising:

a motor;

a pump driven by the motor and having a plurality of stages, each stage comprising:

an impeller for moving fluid;

a diffuser downstream of the impeller:

the diffuser and the impeller each having a plurality of vanes formed on an exterior surface;

at least some of the vanes comprising;

a leading edge at a downstream end of the vane;

trailing edge at an upstream end of the vane;

a curved high pressure surface extending between the leading edge and the trailing edge;

a curved low pressure surface extending between the leading edge and the trailing edge opposite the high pressure surface, the low pressure surface having a length greater than a length of the high pressure surface so that fluid flowing the low pressure surface is substantially laminar;

a bump formed on the low pressure surface, the bump having a first end, a second end, and a length between the first and second ends that is less than the length of the low pressure surface;

wherein the bump has a radius of curvature that is smaller than a radius of curvature of other portions of the low pressure surface; and wherein the vane has a width measured from the low pressure surface to the high pressure surface that is greater within the bump than on the other of the vane.

2. The ESP of claim 1, wherein the width of each vane increases from the leading edge to the first end of the bump and decreases from the second end of the bump to the trailing edge.

3. The ESP of claim 2, wherein a maximum width of the vane is located about halfway between the leading edge and the trailing edge.

4. The ESP of claim 1, wherein a maximum width of the vane is closer to the leading edge than to the trailing edge.

5. The ESP of claim 1, wherein a maximum width of the vane is located closer to the trailing edge than to the leading edge.

6. The ESP of claim 1, wherein the width of the vane increases at a first rate between the leading edge and the first end of the bump and the width of the vane increases at a second rate between the first end and a maximum width of the vane, which is located between the first and second ends of the bump, the second rate being greater than the first rate.

7. The ESP of claim 6, wherein the width of the vane decreases from the maximum width to the second end of the bump at the second rate.

8. The ESP of claim 6, wherein the width of the vane decreases from the second end to the trailing edge at the first rate.

9. The ESP of claim 1, wherein the radius of curvature of the bump has a center point spaced from a center point of the radius of curvature of the remaining portion of the low pressure surface.

10. The ESP of claim 1, wherein a maximum width of the vane is located halfway between the first and second ends of the bump.

11. An electric submersible pump(ESP)assembly comprising:

a pump having a plurality of impellers of moving fluid;

a motor coupled to the submersible pump to rotate the impellers in the pump;

a plurality of diffusers in the pump, each of the diffusers being downstream of one of the impellers;

each of the plurality of diffusers including a frustoconical body having a central bore for passage of a rotating shaft, and a plurality of vanes formed on an exterior surface of the frustoconical body;

each of the plurality of vanes comprising:

a leading edge at a downstream end of the vane;

a trailing edge at an upstream end of the vane;

a curved high pressure surface extending between the leading edge and the trailing edge;

a curved low pressure surface extending between the leading edge and the trailing edge opposite the high pressure surface, the low pressure surface having a bump formed thereon;

the bump having a first end and a second end, the first end of the bump being closer to the leading edge of the vane than to the trailing edge of the vane;

wherein a width of each vane measured from the high pressure surface to the low pressure surface increases at a first rate from the leading edge to the first end of the bump and increases at a second rate from the first end of the bump to a maximum width of the bump, the second rate being greater than the first rate.

12. The ESP of claim 11, wherein the maximum width of the bump is located halfway between the leading edge and the trailing edge.

13. The ESP of claim 11, wherein the maximum width of the bump is between two and four times a width of the vane at the first end.

14. The ESP of claim 11, wherein the maximum width of the bump is located closer to the trailing edge than to the leading edge.

15. The ESP of claim 11, wherein the width of the vane decreases at the second rate from the maximum width of the bump to the second end of the bump.

16. The ESP of claim 15, wherein the width of the vane decreases in width at the first rate from the second end of the bump to the trailing edge.

17. The ESP of claim 15, wherein the second end of the bump is located at the trailing edge.

18. An electric submersible pump (ESP) assembly comprising:

a motor;

a pump driven by the motor and having a plurality of stages, each stage comprising:

an impeller for moving fluid;

a diffuser downstream of the impeller;

the diffuser and the impeller each having a plurality of vanes formed on an exterior surface;

at least some of the vanes comprising:

a leading edge at a downstream end of the vane;

a trailing edge at an upstream end of the vane;

a curved high pressure surface extending between the leading edge and the trailing edge; and a curved low pressure surface extending between the leading edge and the trailing edge opposite the high pressure surface, the low pressure surface having a first radius of curvature and a second radius of curvature, the second radius of curvature being smaller than the first rate of curvature, defining a bump having a first end and a second end, the vane having a maximum width measured from the low pressure surface to the high pressure surface and located between the first and second ends of the bump at least two to four times greater than a width of the vane at the first end of the bump.

19. The ESP of claim 18, wherein the width of the vane increases at a first rate along the first radius of curvature between the leading edge and the first end of the bump and the width of the vane increases in at a second rate along the second radius of curvature between the first end of the bump and the maximum width of the vane, the second rate being greater than the first rate.

20. The ESP of claim 19, wherein the width of the vane decreases from the maximum width of the vane to the second end of the bump at the second rate.

* * * * *

UNITED STATES PATENT AND TRADEMARK OFFICE

CERTIFICATE OF CORRECTION

PATENT NO. : 9,109,602 B2
APPLICATION NO. : 13/435559
DATED : August 18, 2015
INVENTOR(S) : Baojun Song It is certified that error appears in the above-identified patent and that said Letters Patent is hereby corrected as shown below:

In the claims,
Column 7, line 9, delete “downstream” and insert -- upstream --
Column 7, line 10, delete “upstream” and insert -- downstream --
Column 8, line 6, delete “downstream” and insert -- upstream --
Column 8, line 7, delete “upstream” and insert -- downstream --
Column 8, line 50, delete “downstream” and insert -- upstream --
Column 8, line 51, delete “upstream” and insert -- downstream --

Signed and Sealed this
Fifth Day of April, 2016

Michelle K. Lee

Michelle K. Lee
*Director of the United States Patent and Trademark Office*